US009649742B2

(12) United States Patent
Lefevre et al.

(10) Patent No.: US 9,649,742 B2
(45) Date of Patent: May 16, 2017

(54) POLISHING PAD HAVING POLISHING SURFACE WITH CONTINUOUS PROTRUSIONS

(71) Applicant: NexPlanar Corporation, Hillsboro, OR (US)

(72) Inventors: Paul Andre Lefevre, Portland, OR (US); William C. Allison, Beaverton, OR (US); Alexander William Simpson, Hillsboro, OR (US); Diane Scott, Portland, OR (US); Ping Huang, Beaverton, OR (US); Leslie M. Charns, Portland, OR (US); James Richard Rinehart, Portland, OR (US); Robert Kerprich, Portland, OR (US)

(73) Assignee: NexPlanar Corporation, Hillsboro, OR (US)

( * ) Notice: Subject to any disclaimer, the term of this patent is extended or adjusted under 35 U.S.C. 154(b) by 1095 days.

(21) Appl. No.: 13/747,139

(22) Filed: Jan. 22, 2013

(65) Prior Publication Data

US 2014/0206268 A1 Jul. 24, 2014

(51) Int. Cl.

| | |
|---|---|
| ***B24B 37/22*** | (2012.01) |
| ***B24B 37/26*** | (2012.01) |
| ***B24B 37/20*** | (2012.01) |

(52) U.S. Cl.

CPC ..... *B24B 37/26* (2013.01); *B24B 37/205* (2013.01); *B24B 37/22* (2013.01)

(58) Field of Classification Search

CPC ..... B24B 37/26; B24B 37/22; B24B 37/20; B24B 37/205

USPC ..... 451/526, 527, 529

See application file for complete search history.

(56) References Cited

U.S. PATENT DOCUMENTS

| | | | | |
|---|---|---|---|---|
| 5,297,364 | A | 3/1994 | Tuttle | |
| 5,632,790 | A | 5/1997 | Wiand | |
| 6,093,651 | A | 7/2000 | Andideh et al. | |
| 6,332,832 | B1 | 12/2001 | Suzuki | |
| 6,428,405 | B1 | 8/2002 | Tsuchiya | |
| 6,495,464 | B1 | 12/2002 | Boyd et al. | |
| 6,500,054 | B1 | 12/2002 | Ma et al. | |
| 7,238,093 | B1 * | 7/2007 | Sakamoto | B24B 37/26 257/E21.23 |
| 2002/0151253 | A1 | 10/2002 | Kollodge et al. | |
| 2004/0003895 | A1 | 1/2004 | Amano et al. | |
| 2008/0160890 | A1 | 7/2008 | He et al. | |

(Continued)

FOREIGN PATENT DOCUMENTS

| | | |
|---|---|---|
| EP | 1 447 841 | 8/2004 |
| JP | 2000-246629 | 9/2000 |

(Continued)

OTHER PUBLICATIONS

International Search Report and Written Opinion of the International Searching Authority dated Feb. 5, 2014, in International Patent Application No. PCT/US2014/011792.

(Continued)

*Primary Examiner* — Robert Rose

(74) *Attorney, Agent, or Firm* — Thomas Omholt; Erika Wilson; Justin K. Brask

(57) ABSTRACT

Polishing pads having a polishing surface with continuous protrusions are described. Methods of fabricating polishing pads having a polishing surface with continuous protrusions are also described.

22 Claims, 13 Drawing Sheets

(56) References Cited

U.S. PATENT DOCUMENTS

| | | | |
|---|---|---|---|
| 2012/0094586 | A1 | 4/2012 | Huang et al. |
| 2012/0282849 | A1 | 11/2012 | Kerprich et al. |
| 2012/0302148 | A1 | 11/2012 | Bajaj et al. |
| 2013/0017764 | A1 | 1/2013 | Allison et al. |

FOREIGN PATENT DOCUMENTS

| | | | |
|---|---|---|---|
| JP | 2001150332 | A | 6/2001 |
| JP | 2002246343 | A | 8/2002 |
| JP | 2005-183707 | | 7/2005 |
| JP | 2005-183712 | | 7/2005 |
| KR | 1020120135210 | A | 12/2012 |
| TW | 526554 | A | 4/2003 |
| TW | 201302382 | A1 | 1/2013 |
| WO | WO-2009/025748 | | 2/2009 |

OTHER PUBLICATIONS

International Search Report and Written Opinion of the International Searching Authority dated Mar. 2, 2014, in International Patent Application No. PCT/US2014/011792.

International Preliminary Report on Patentability from PCT/US2014/011792 mailed Aug. 6, 2015, 9 pgs.

Japanese Intellectual Property Office, Notice of Reasons for Rejection issued with respect to Japanese Patent Application No. 2015-552686 on Jul. 12, 2016.

Taiwan Intellectual Property Office, Search Report issued in connection with Taiwan Patent Application No. 103102159 on Mar. 7, 2016.

Korean Intellectual Property Office, Notification of Grounds for Refusal issued in connection with Korean Patent Application No. 10-2015-7020592 on Sep. 30, 2016.

* cited by examiner

POLISHING PAD HAVING POLISHING SURFACE WITH CONTINUOUS PROTRUSIONS

TECHNICAL FIELD

Embodiments of the present invention are in the field of chemical mechanical polishing (CMP) and, in particular, polishing pads having a polishing surface with continuous protrusions.

BACKGROUND

Chemical-mechanical planarization or chemical-mechanical polishing, commonly abbreviated CMP, is a technique used in semiconductor fabrication for planarizing a semiconductor wafer or other substrate.

The process uses an abrasive and corrosive chemical slurry (commonly a colloid) in conjunction with a polishing pad and retaining ring, typically of a greater diameter than the wafer. The polishing pad and wafer are pressed together by a dynamic polishing head and held in place by a plastic retaining ring. The dynamic polishing head is rotated during polishing. This approach aids in removal of material and tends to even out any irregular topography, making the wafer flat or planar. This may be necessary in order to set up the wafer for the formation of additional circuit elements. For example, this might be necessary in order to bring the entire surface within the depth of field of a photolithography system, or to selectively remove material based on its position. Typical depth-of-field requirements are down to Angstrom levels for the latest sub-50 nanometer technology nodes.

The process of material removal is not simply that of abrasive scraping, like sandpaper on wood. The chemicals in the slurry also react with and/or weaken the material to be removed. The abrasive accelerates this weakening process and the polishing pad helps to wipe the reacted materials from the surface. In addition to advances in slurry technology, the polishing pad plays a significant role in increasingly complex CMP operations.

However, additional improvements are needed in the evolution of CMP pad technology.

SUMMARY

Embodiments of the present invention include polishing pads having a polishing surface with continuous protrusions.

In an embodiment, a polishing pad for polishing a substrate includes a polishing body having a polishing side opposite a back surface. The polishing pad also includes a polishing surface having a plurality of cylindrical protrusions continuous with the polishing side of the polishing body.

In another embodiment, a polishing pad for polishing a substrate includes a polishing body having a polishing side opposite a back surface. The polishing pad also includes a polishing surface having a plurality of protrusions continuous with the polishing side of the polishing body. Each protrusion has a modified-quadrilateral polygon shape in a plane of the polishing surface.

BRIEF DESCRIPTION OF THE DRAWINGS

FIG. 8B illustrates an exemplary center field for the polishing pad of FIG. 8A where the polishing surface includes a button region having a modified square shape, in accordance with an embodiment of the present invention.

FIG. 8C illustrates an exemplary outer field for the polishing pad of FIG. 8A where the polishing surface includes a solid ring encompassing the plurality of modified quadrilateral protrusions at an outer most edge of the polishing side of the polishing body, in accordance with an embodiment of the present invention.

DETAILED DESCRIPTION

Polishing pads having a polishing surface with continuous protrusions are described herein. In the following description, numerous specific details are set forth, such as specific polishing pad designs and compositions, in order to provide a thorough understanding of embodiments of the present invention. It will be apparent to one skilled in the art that embodiments of the present invention may be practiced without these specific details. In other instances, well-known processing techniques, such as details concerning the combination of a slurry with a polishing pad to perform chemical mechanical planarization (CMP) of a semiconductor substrate, are not described in detail in order to not unnecessarily obscure embodiments of the present invention. Furthermore, it is to be understood that the various embodiments shown in the figures are illustrative representations and are not necessarily drawn to scale.

Polishing pads for polishing substrates in CMP operations typically include at least one surface with physical grooves or protrusions formed therein. The grooves or protrusions may be arranged to balance an appropriate amount of surface area for polishing the substrate while providing a reservoir for slurry used in the CMP operation. In accordance with embodiment of the present invention, protrusion patterns are described for polishing surfaces of polishing pads.

Protrusion patterns described herein may provide benefits for, or may be advantageous over prior art polishing pads for, polishing substrates in a CMP operation using slurry. For example, advantages of protrusion patterns described herein may include (a) improved averaging of a slurry-based polish process across a polished substrate as the polishing pad is rotated relative to a polished substrate, and (b) improved slurry retention on the polishing pad relative to pads with conventional groove or protrusion patterns.

Basic embodiments of the present invention include the use of protrusion features having relatively similar values for all dimensions within a polishing plane of the polishing surface. More involved embodiments may include the use of cylindrical protrusions or the use of modified-quadrilateral protrusions, or both. In either case, the protrusions may be formed by a molding process, as such protrusion shapes would typically otherwise be impractical to form by cutting a pattern into a polishing surface.

Conventional polishing pads typically have concentric circular groove patterns with radial grooves there through. For example, FIG. 1 illustrates a top-down plan view of a concentric circular groove pattern disposed in the polishing surface of a conventional polishing pad.

Figure 1:
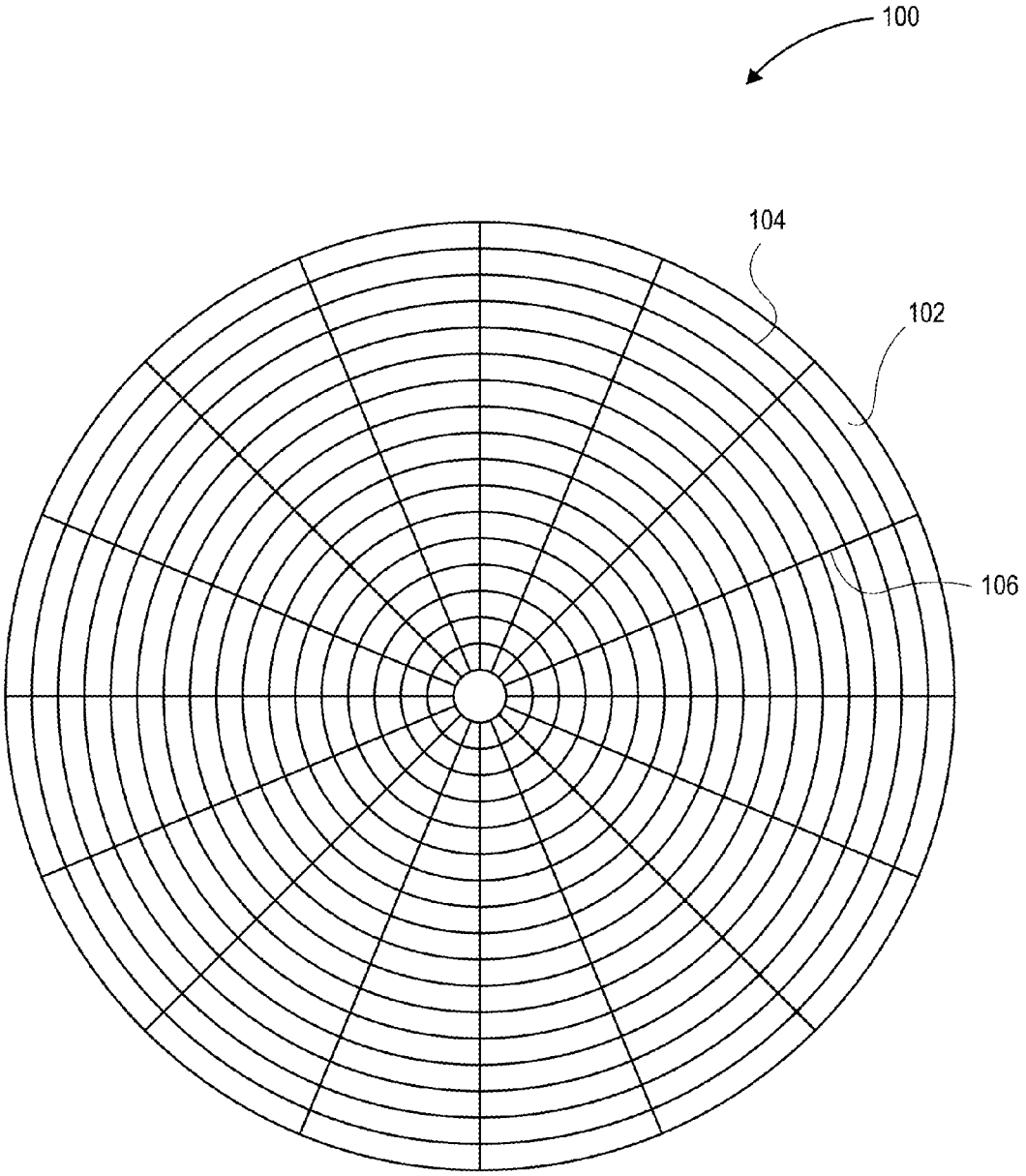
FIG. 1 illustrates a top-down plan view of a concentric circular groove pattern disposed in the polishing surface of a conventional polishing pad.

Referring to FIG. 1, a polishing pad 100 includes a polishing body having a polishing surface 102 and a back surface (not shown). The polishing surface 102 has a pattern of grooves of concentric circles 104. The pattern of grooves also includes a plurality of radial grooves 106 continuous from the inner most circle to the outer most circle, as depicted in FIG. 1. The potential drawbacks of such a groove pattern can include poor averaging of slurry distribution across large concentric grooves and/or slurry loss by drainage along radial grooves.

In contrast to FIG. 1, and as exemplified in FIG. 2A below, embodiments of the present invention include patterns of protrusions which are spaced narrowly relative to conventional groove spacing. Furthermore, all dimensions of the protrusions in a plane of the polishing surface are relatively similar and, hence, each protrusion can be effective for providing consistent localized polishing characteristics. By avoiding conventional grooving, slurry retention on the polishing pad may be improved by the use of such protrusions.

In an aspect of the present invention, a polishing pad may be fabricated with a polishing surface having a pattern of continuous cylindrical protrusions thereon. As an example, FIG. 2A illustrates a top-down plan view of a cylindrical protrusion pattern disposed in the polishing surface of a polishing pad, in accordance with an embodiment of the present invention. FIG. 2B is an enlarged view of the protrusion pattern of a portion of FIG. 2A, while FIG. 2C is a cross-sectional view taken along the a-a' axis of FIG. 2B.

Figure 2A:
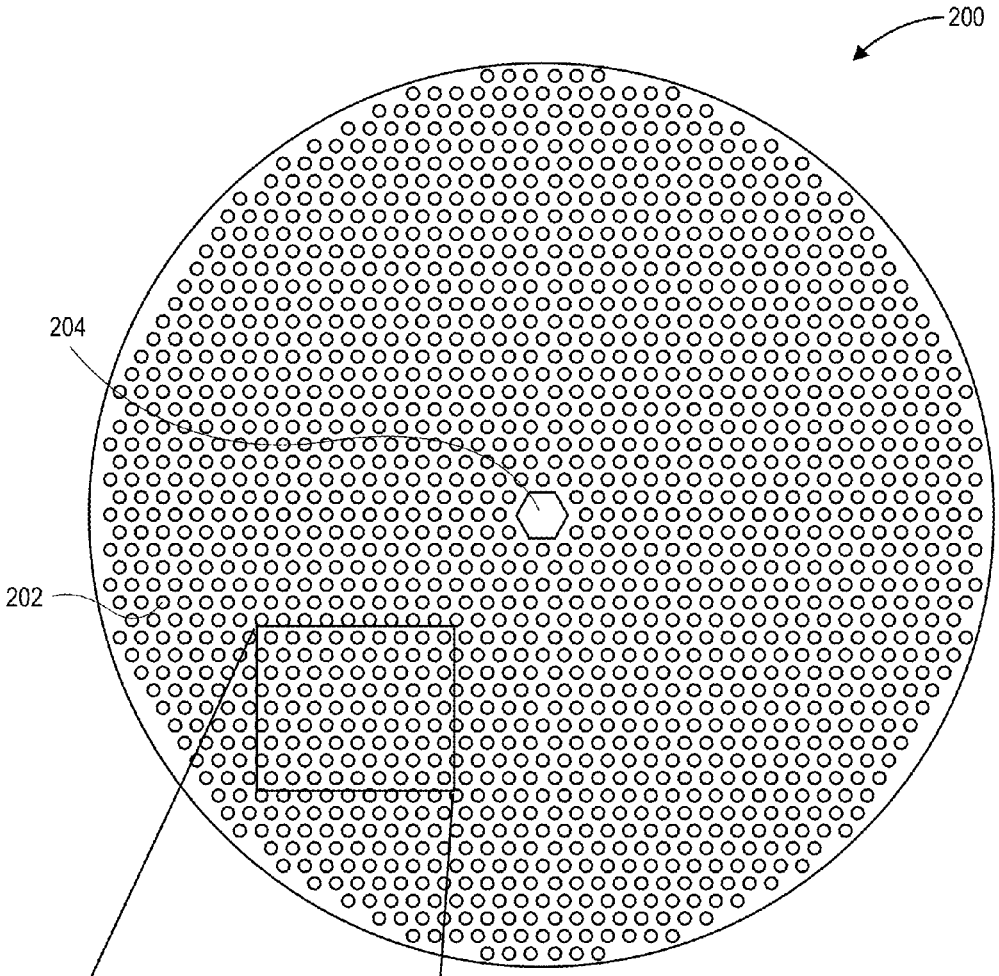
FIG. 2A illustrates a top-down plan view of a cylindrical protrusion pattern disposed in the polishing surface of a polishing pad, in accordance with an embodiment of the present invention.
Figure 2B:
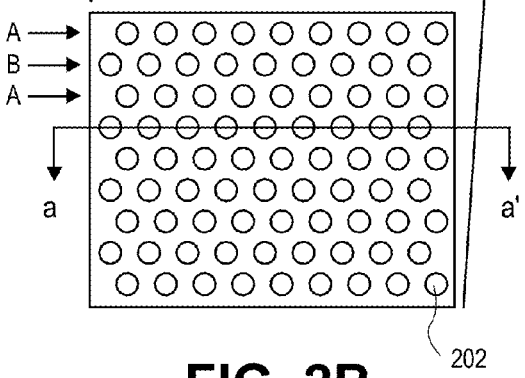
FIG. 2B is an enlarged view of the protrusion pattern of a portion of FIG. 2A, in accordance with an embodiment of the present invention.
Figure 2C:
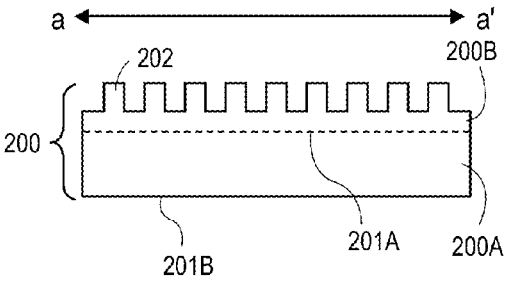
FIG. 2C is a cross-sectional view taken along the a-a' axis of FIG. 2B, in accordance with an embodiment of the present invention.

Referring to FIGS. 2A and 2C, a polishing pad 200 includes a polishing body (shown as 200A in FIG. 2C). The polishing body has a polishing side 201A opposite a back surface 201B. The polishing pad 200 also includes a polishing surface, as seen in the top-down view of FIG. 2A and referred as 200B of FIG. 2C. The polishing surface has a plurality of cylindrical protrusions 202 continuous with the polishing side 201A of the polishing body 200A. Referring to FIG. 2B, an enlarged view of field detail of exemplary protrusions 202 is provided. The portion of the pad 200 shown in FIG. 2C is a cross-sectional view of the portion enlarged in FIG. 2B.

Referring again to FIG. 2C, the cylindrical protrusions 202 are continuous in the sense that they form a common unified polishing surface layer, best seen as a unified region 200B. The continuous nature of the cylindrical protrusions is in contrast to discrete protrusions, such as affixed tiles, that are in no way connected to one another on a surface to which they are affixed. Furthermore, in one embodiment, the polishing surface 200B and the polishing body are unified. In that case, the dotted line showing separation between regions 200A and 200B is provided merely as a visual aid for conceptualizing the difference between the polishing body and polishing surface regions of a polishing pad. Furthermore, in one embodiment, the polishing body 200A and polishing surface 200B are together both homogeneous and unitary. In a specific exemplary embodiment, the polishing body 200A and polishing surface 200B are composed of a same molded polyurethane material, exemplary details of which are provided below.

Referring again to FIG. 2B, the plurality of cylindrical protrusions 202 may be arranged in a global pattern with at least some level of repetition. For example, in one embodiment as illustrated in FIG. 2B, the plurality of protrusions 202 is arranged in a hexagonal packed patterned in that rows of the cylindrical protrusions are staggered in an ABA arrangement. Other exemplary arrangements are described in greater detail below.

Figure 3A:
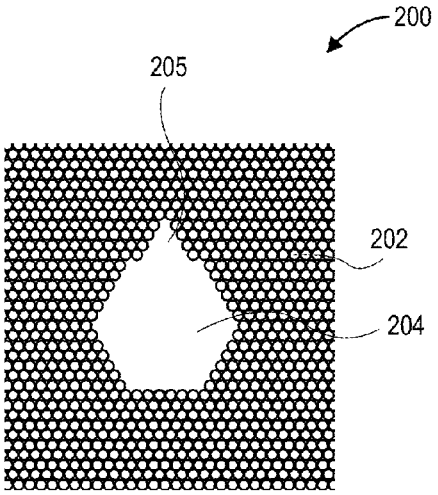
FIG. 3A illustrates an exemplary center field for the polishing pad of FIGS. 2A-2C where the polishing surface includes a button region having a triangular clocking mark on one side of the hexagonal shape of the button, in accordance with an embodiment of the present invention.

Referring again to FIG. 2A, the polishing pad 200 may include a central button 204. The button 204 can be a raised portion of pad material (e.g., co-planar and continuous with the cylindrical protrusions 202) that provides a region for pad property testing. In one such embodiment, polishing is not performed in the region of button 204. The button 204 may a shape compatible with the overall pattern of cylindrical protrusions 202. In an exemplary embodiment, referring to FIGS. 2A and 3A (the latter illustrating a possible embodiment for a center field portion of pad 200), the plurality of protrusions 202 has a global hexagonal packed arrangement, and button 204 has a hexagonal shape. Furthermore, the button 204 may include a clocking feature which provides pad fabrication information and/or alignment information for polishing or for adhering a pad to a platen. In a specific such embodiment, referring to FIG. 3A, the button region 204 further includes a triangular clocking mark on one side of the hexagonal shape. In a particular embodiment, the hexagonal center button 204 is approximately 1 inch across, and the clocking mark 205 is triangular on one face of the hexagon.

Figure 3B:
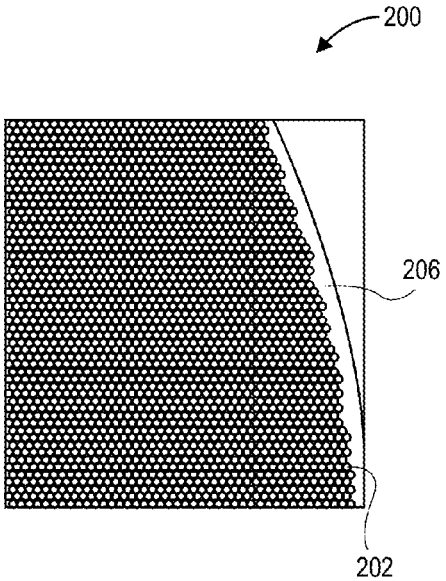
FIG. 3B illustrates an exemplary outer field for the polishing pad of FIGS. 2A-2C where the polishing surface includes a solid ring encompassing the plurality of cylindrical protrusions at an outer most edge of the polishing side of the polishing body, in accordance with an embodiment of the present invention.

The outer portion of polishing pad 200 may be tailored for specific polishing purposes. For example, FIG. 3B illustrates an exemplary outer field for the polishing pad of FIGS. 2A-2C where the polishing surface includes a solid ring 206 encompassing the plurality of cylindrical protrusions 202 at an outer most edge of the polishing side of the polishing body, in accordance with an embodiment of the present invention. In a specific embodiment as depicted in FIG. 3B, a hexagonal-packed pattern of cylindrical protrusions 202 terminates proximate to the ring 206 in a staggered arrangement. In a particular embodiment, the solid outer ring 206 has an average width of approximately 125 mils. In an embodiment, the inner edge of the solid outer ring 206 is shaped to avoid large down space, while providing an edge of the pad 200 that is continuous and has a dam effect on slurry. Overall, however, the solid ring may have an irregular shape that follows the contour of the pattern of cylindrical protrusions, as is depicted in FIG. 3B.

Figure 4:
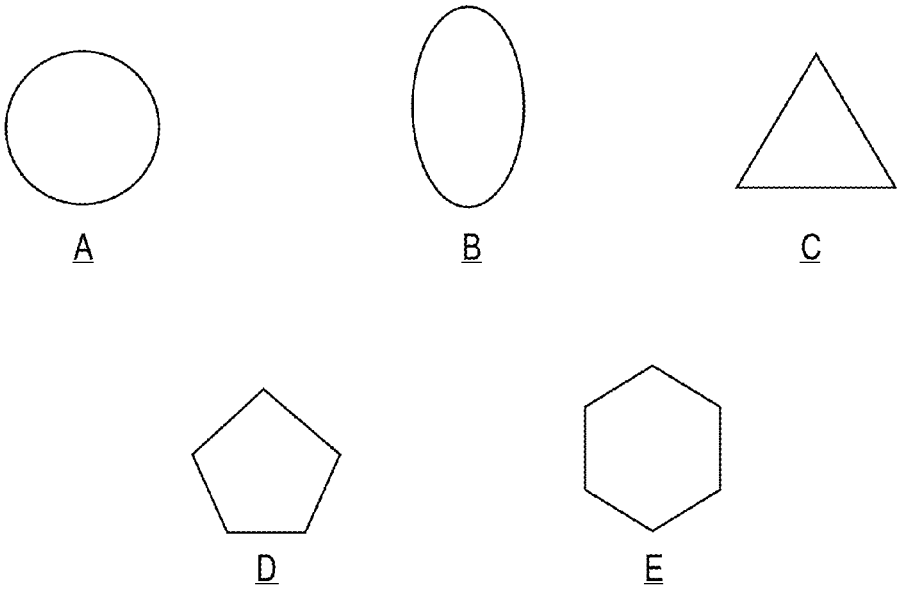
FIG. 4 illustrates options for the polishing surface shape of a cylindrical protrusion such as a circle ("A"), an oval ("B"), a triangle ("C"), a pentagon ("D") and a hexagon ("E"), in accordance with an embodiment of the present invention.

Referring again to FIGS. 2A, 2B, 3A and 3B, each of the cylindrical protrusions 202 are depicted to have a circular shape in a plane of the polishing surface of the polishing pad 200. However, other cylindrical shapes may also be suitable for providing an effective polishing surface. Thus, the term "cylindrical" is not limited to protrusions have a top-down circular profile. Rather, as used in embodiments herein, a cylindrical protrusion is one that maintains a same shape in a vertical direction (e.g., has essentially or precisely vertical sidewalls) throughout the protrusions. The cylindrical profile describes the nature of the protrusions having approximately the same dimension in all 360 degrees of the protrusion shape. This is, the cylindrical protrusions 202 are distinguished from a large arcing grove type polishing feature. In one embodiment, the cylindrical protrusion shape is one that would otherwise be impractical to achieve by merely cutting a pattern into a polishing surface, e.g., in some form of an XY grid cutting approach (such as cylinders having basic square or basic rectangular geometries as viewed from the top-down of the cylindrical protrusion). For example, Referring to FIG. 4, in an embodiment, each of the plurality of cylindrical protrusions 202 of polishing pad 200 has a shape in a plane of the polishing surface such as, but not limited to, a circle ("A" from FIG. 4; also used as exemplary cylindrical protrusion in FIGS. 2A, 2B), an oval ("B" from FIG. 4), a triangle ("C" from FIG. 4), or a polygon having five or more sides (e.g., the pentagon "D" from FIG. 4, or the hexagon "E" from FIG. 4). In one such embodiment, the cylindrical protrusions 202 are formed by a molding process, as described in greater detail below. It is noted that all of these options for the cylindrical protrusions 202 all have the same cross-sectional shape as viewed in FIG. 2C.

Figure 5A:
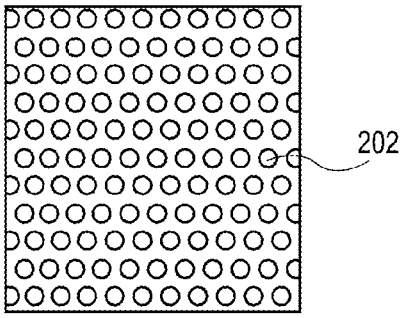
FIG. 5A illustrates a pattern of cylindrical protrusions in a hexagonal packed arrangement, in accordance with an embodiment of the present invention.
Figure 5B:
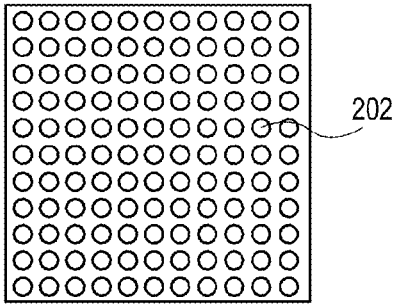
FIG. 5B illustrates a pattern of cylindrical protrusions in a square packed arrangement, in accordance with an embodiment of the present invention.

Referring again to FIGS. 2A, 2B, 3A and 3B, the pattern of the plurality of protrusions 202 is not limited to a hexagonal packed arrangement. Other arrangements may also provide a packing of cylindrical protrusions suitable for polishing a substrate or wafer. Referring to FIG. 5B, in an embodiment, a plurality of cylindrical protrusions 202 is arranged in a square-packed pattern, in that all successive rows of protrusions are aligned with one another. This is in contrast to the staggered arrangement resulting from hexagonal packing, illustrated again in FIG. 5A for comparison. In other embodiments, the cylindrical protrusions 202 are arranged in a randomized pattern, with effectively no long range pattern repetition.

Figure 5C:
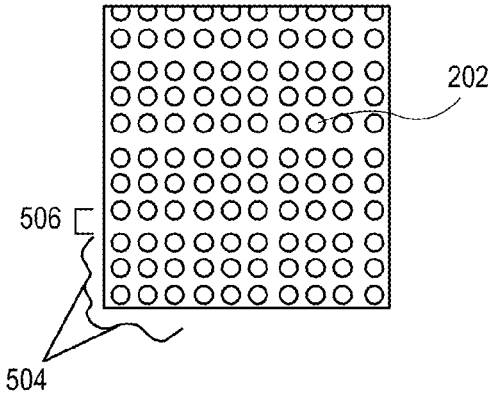
FIG. 5C illustrates a pattern of cylindrical protrusions in a generally square packed arrangement, with larger spacing between groupings of protrusions, in accordance with an embodiment of the present invention.

Additionally, the spacing between protrusions need not always be the same. For example, groupings of tighter spaced protrusions may be arranged with larger spacings between groupings in order to provide channels between the grouping. That is, in one embodiment, a pattern of cylindrical protrusions is arranged to have a plurality of high density regions having less spacing between adjacent protrusions within a high density region as compared to spacing between adjacent protrusions of adjacent high density regions. In an exemplary embodiment, FIG. 5C illustrates a pattern of cylindrical protrusions 202 in a generally square packed arrangement, with larger spacing between groupings of protrusions. Referring to FIG. 5C, a grouping 504 has less spacing between protrusions 202 within grouping 504 than the spacing 506 between adjacent groupings. In the specific example, of FIG. 5C, an XY channel arrangement results between groupings. The inclusion of such channels may be used for slurry transport or for modifying other polishing characteristics of a polishing pad. Furthermore, in an embodiment, since the protrusions are molded and not cut, the spacing between grouping can be varies beyond simple removal of one row or column of protrusions between grouping, as would other wise be required for cutting of a pattern.

Figure 6A:
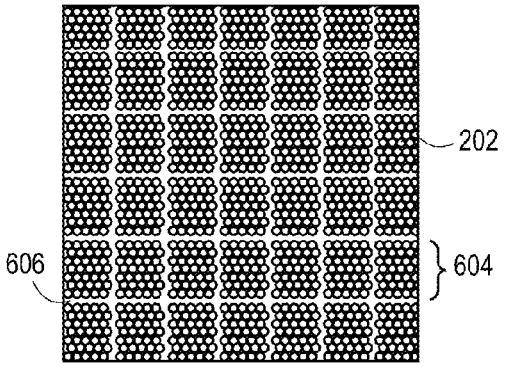
FIG. 6A illustrates a pattern of cylindrical protrusions in a generally hexagonal packed arrangement, with larger spacing between substantially square or rectangular shaped groupings of protrusions, in accordance with an embodiment of the present invention.
Figure 6B:
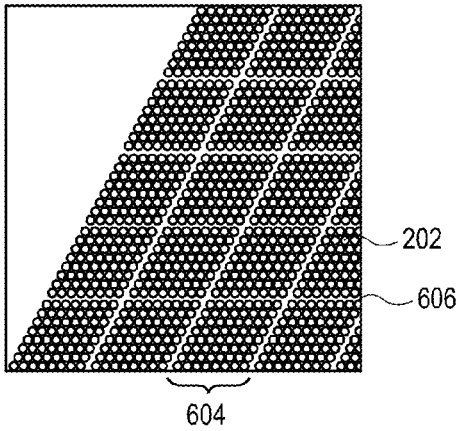
FIG. 6B illustrates a pattern of cylindrical protrusions in a generally hexagonal packed arrangement, with larger spacing between rhombic shaped groupings of protrusions, in accordance with an embodiment of the present invention.
Figure 6C:
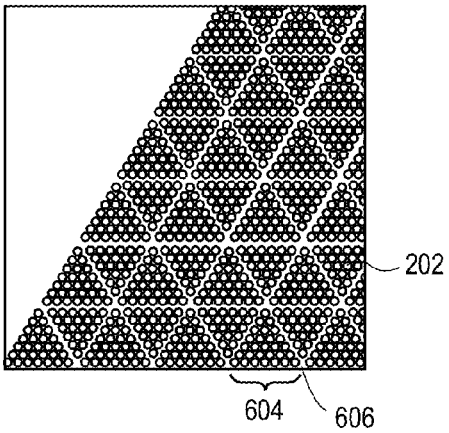
FIG. 6C illustrates a pattern of cylindrical protrusions in a generally hexagonal packed arrangement, with larger spacing between triangular shaped groupings of protrusions, in accordance with an embodiment of the present invention.
Figure 6D:
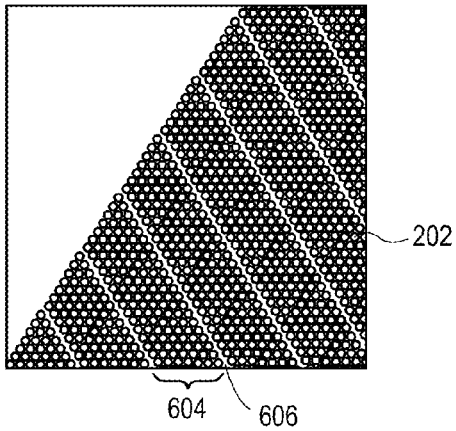
FIG. 6D illustrates a pattern of cylindrical protrusions in a generally hexagonal packed arrangement, with larger spacing between strip-based shaped groupings of protrusions, in accordance with an embodiment of the present invention.

With reference to the description of FIG. 5C, groupings of protrusions 202, with larger spacing between such groupings, may also be based on a generally hexagonal packed arrangement of protrusions. For example, in an embodiment, a pattern of cylindrical protrusions 202 includes high density regions 604 are arranged in a hexagonal-packed pattern with larger spacings 606 between such high density groupings (e.g., ultimately forming channels). The high density regions can, in one embodiment, have a general shape such as, but not limited to, a substantially square or rectangular shape with spacing between each of the high density regions based on an X-Y grid pattern (FIG. 6A), a rhombic shape (FIG. 6B), a triangular shape (FIG. 6C), or a strip-based shape (FIG. 6D).

Figure 7:
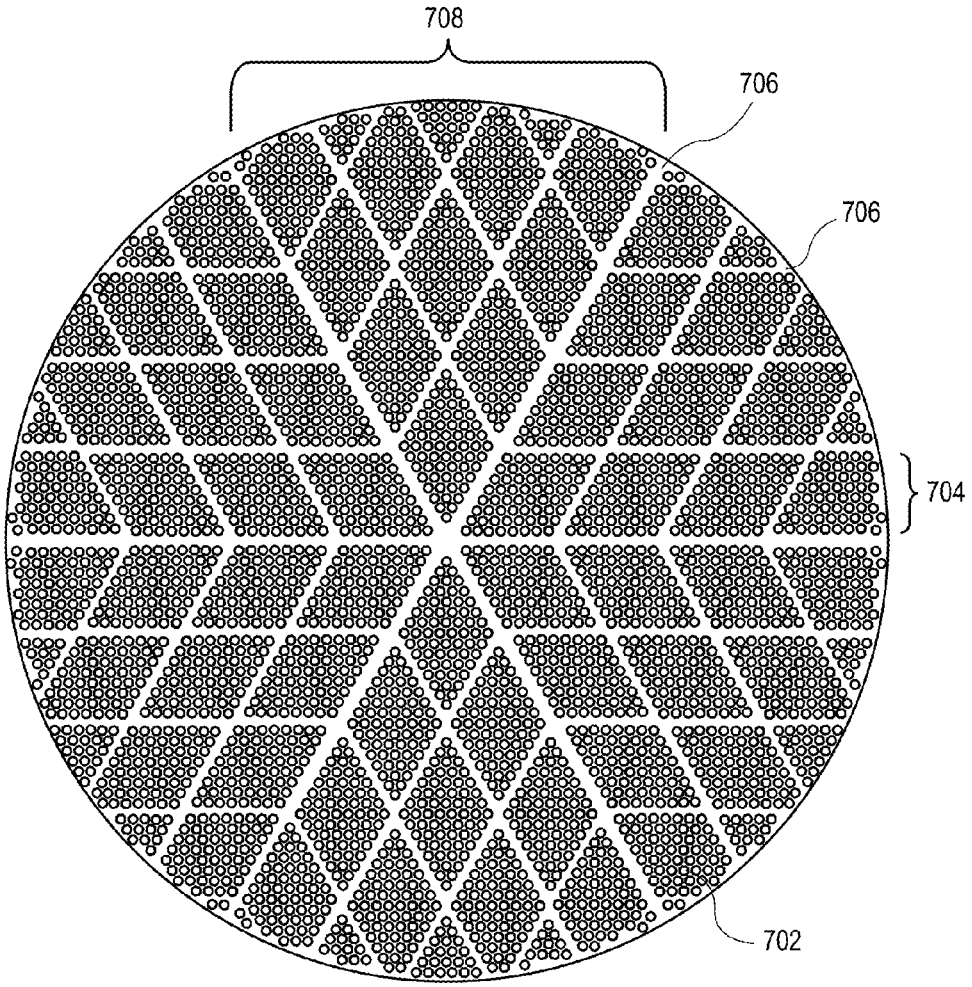
FIG. 7 illustrates a pattern of cylindrical protrusions in a generally hexagonal packed arrangement, with larger spacing between rhombic shaped groupings of protrusions, the rhombic shaped groupings arranged in sub-patterns, in accordance with an embodiment of the present invention.

The above described high density regions can have sub-patterns that combine to form one larger pattern based on pad orientation. In an exemplary embodiment, FIG. 7 illustrates a pattern of cylindrical protrusions 202 in a generally hexagonal packed arrangement, with larger spacing 706 between rhombic shaped groupings 704 of protrusions, the rhombic shaped groupings arranged in sub-patterns 708, in accordance with an embodiment of the present invention. Effectively, a sub-pattern 708 of the high density regions 704 is repeated every 60 degree rotation of the polishing pad. The result is a pattern that originates from a central point 710, as depicted in FIG. 7.

Figure 8A:
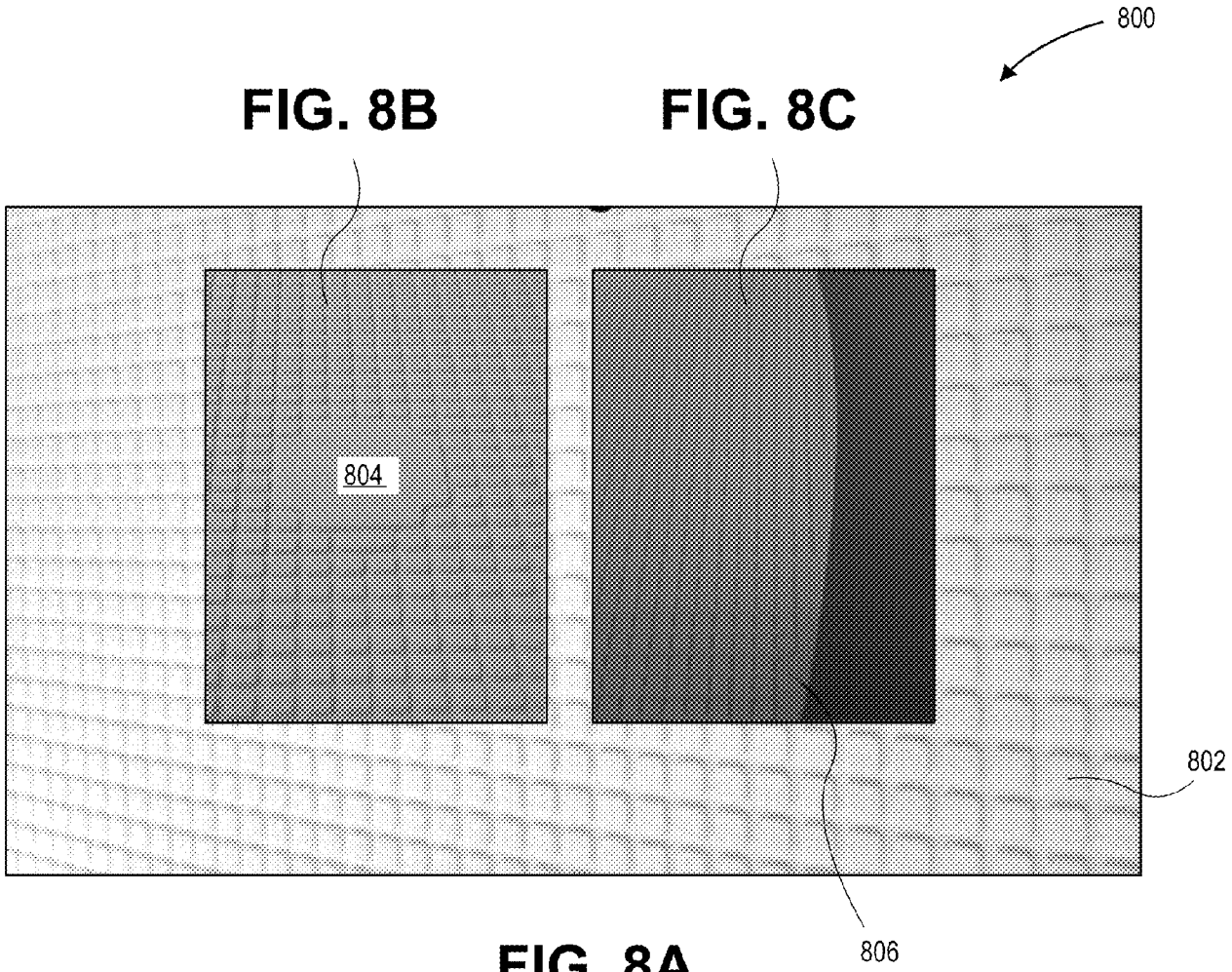
FIG. 8A illustrates an angled plan view of a modified quadrilateral protrusion pattern disposed in the polishing surface of a polishing pad, in accordance with an embodiment of the present invention.

In another aspect of the present invention, a polishing pad may be fabricated with a polishing surface having a pattern of continuous protrusions based on a modified quadrilateral shape thereon. As an example, FIG. 8A illustrates an angled plan view of a modified quadrilateral protrusion pattern disposed in the polishing surface of a polishing pad, in accordance with an embodiment of the present invention. Referring to FIG. 8A, a polishing pad 800 includes a polishing body and a polishing surface having a plurality of protrusions 802 continuous with the polishing side of the polishing body. Each protrusion 802 has a modified-quadrilateral polygon shape in a plane of the polishing surface.

Similar to the protrusions 202 of pad 200, e.g., as described in association with FIG. 2C, the protrusions 802 of polishing pad 800 are continuous in the sense that they form a common unified polishing surface layer. The continuous nature of the protrusions 802 is in contrast to discrete protrusions, such as affixed tiles, that are in no way connected to one another on a surface to which they are affixed. Furthermore, in one embodiment, the polishing surface and the polishing body of polishing pad 800 are unified. Furthermore, in one embodiment, the polishing body and polishing surface of polishing pad 800 are together both homogeneous and unitary, exemplary details of materials for which are provided below.

Referring again to FIG. 8A, the plurality of cylindrical protrusions 802 may be arranged in a global pattern with at least some level of repetition. For example, in one embodiment as illustrated in FIG. 8A, the plurality of protrusions 802 is arranged in a square packed patterned in that rows of the protrusions 802 form an XY grid arrangement. Other exemplary arrangements may be similar to those described above in association with polishing pad 200. For example, similar to FIGS. 5C, 6A-6D and 7, in one embodiment, the plurality of protrusions 802 is arranged in a plurality of high density regions having less spacing between adjacent protrusions within a high density region than between adjacent protrusions of adjacent high density regions. In a specific=such embodiment, each of the high density regions is substantially square or rectangular, and spacing or channels between each of the high density regions of the plurality of high density regions forms an X-Y grid pattern. In another embodiment, the plurality of protrusions 802 has a hexagonal packed or a randomized pattern.

Referring now to inset FIG. 8B, the polishing pad 800 may include a central button 804. The button 804 can be a raised portion of pad material (e.g., co-planar and continuous with the protrusions 802) that provides a region for pad property testing. In one such embodiment, polishing is not performed in the region of button 804. The button 804 may a shape compatible with the overall pattern of protrusions 802. In an exemplary embodiment, referring to FIG. 8B, the plurality of protrusions 802 has a global square packed (or XY grid) arrangement, and button 804 has a modified square shape (in this case, a square having four notched corners). Furthermore, although not depicted the button 204 may include a clocking feature which provides pad fabrication information and/or alignment information for polishing or for adhering a pad to a platen. In one such embodiment, the button region 804 further includes a clocking mark on one side of the modified square shape.

Referring now to inset FIG. 8C, the outer portion of polishing pad 800 may be tailored for specific polishing purposes. For example, 8C provides an exemplary outer field for the polishing pad 800 where the polishing surface includes a solid ring 806 encompassing the plurality of cylindrical protrusions 802 at an outer most edge of the polishing side of the polishing body, in accordance with an embodiment of the present invention. The solid ring 806 is continuous with the polishing side of the polishing body, and a continuous groove is disposed between the solid ring and the plurality of protrusions 802. The continuous edge of the ring 806 can provide a good location for sealing for backside pad cutting and/or providing an edge of the pad 800 that is continuous and has a dam effect on slurry.

Figure 9A:
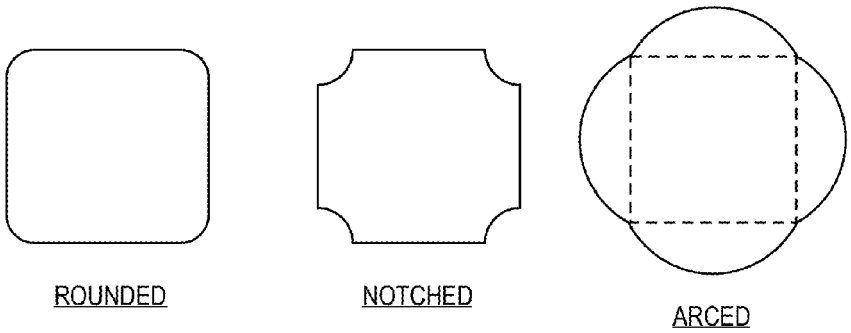
FIG. 9A illustrates options for the polishing surface shape of a modified quadrilateral polishing protrusion, such as a square with four rounded corners, a square with four notched corners, and a square with four arced sides, in accordance with an embodiment of the present invention.

Referring again to FIGS. 8A-8C, each of the protrusions 802 are depicted to have a square shape will all four corners rounded shape in a plane of the polishing surface of the polishing pad 800. However, other modified quadrilateral shapes may also be suitable for providing an effective polishing surface. The modified quadrilateral shape describes the nature of the protrusions having approximately the same dimension in all 360 degrees of the protrusion shape. This is, the protrusions 802 are distinguished from a large arcing grove type polishing feature. In one embodiment, the modified quadrilateral protrusion shape is one that would otherwise be impractical to achieve by merely cutting a pattern into a polishing surface, e.g., in some form of an XY grid cutting approach (such as tiles or protrusions having basic square or basic rectangular geometries as viewed from the top-down of the protrusion). For example, Referring to FIG. 9A, in an embodiment, each of the plurality of modified quadrilateral protrusions 802 of polishing pad 800 has a modification in a plane of the polishing surface such as, but not limited to, one or more rounded corners (a square with four rounded corners is shown in FIG. 9A), a one or more notched corners (a square with four notched corners is shown in FIG. 9A), or one or more arced sides (a square with four arced sides is shown in FIG. 9A). In one such embodiment, the modified quadrilateral protrusions 802 are formed by a molding process, as described in greater detail below.

Figure 9B:
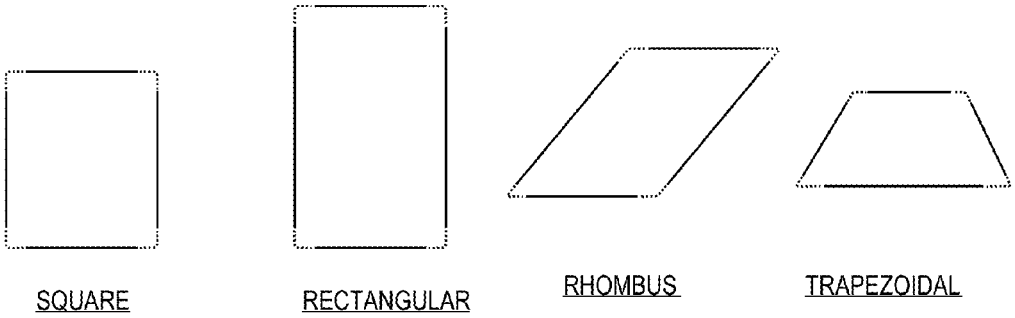
FIG. 9B illustrates options for the quadrilateral shape used as a foundation for a modified quadrilateral polishing protrusion, such as a modified-square shape, a modified-rectangular shape, a modified-rhombus shape, and a modified-trapezoidal shape, in accordance with an embodiment of the present invention.

As mentioned briefly above, the modified quadrilateral shape of protrusions 802 can be one which has one or more corners modified. Referring to FIG. 9B, quadrilateral shapes used as a foundation may include, but are not limited to, a modified-square shape, a modified-rectangular shape, a modified-rhombus shape, or a modified-trapezoidal shape. It is noted that the corners of the quadrilateral shapes of FIG. 9B are depicted with dotted lines, indication that shape modification (such as rounding or notching) may be situated at one or more of these locations. Other options include arcing one or more of the sides of the shapes, as described in association with FIG. 9A. Furthermore, in one embodiment, the modified quadrilateral protrusions are cylindrical in that each protrusion maintains a same shape in a vertical direction (e.g., has essentially or precisely vertical sidewalls) throughout the protrusion. It is noted that all such options for the cylindrical protrusions have the same cross-sectional shape similar to the shape depicted in FIG. 2C.

In an embodiment, polishing pads described herein, such as polishing pad 200 or 800, or the above described variations thereof, each of the polishing protrusions (e.g., the polishing protrusions described in association with FIGS. 2A-2C, 3A, 3B, 4, 5A-5C, 6A-6D, 7, 8A-8C, 9A and 9B) has a maximum lateral dimension approximately in the range of 1-30 millimeters. For example, in the case of a circular shaped cylindrical protrusion, the maximum lateral dimension is the diameter of the circle. In the case of a modified square shape, the maximum lateral dimension is the dimension spanning the modified square shape in the plane of the polishing surface. In an embodiment, a spacing between protrusions is approximately in the range of 0.1-3 millimeters, and can be the same across the pad (e.g., as described in association with FIG. 5B) or can vary across the pad (e.g., as described in association with FIG. 5C). The number of protrusions on a polishing surface can vary by application and/or pad size. In an exemplary embodiment, a polishing pad having a diameter approximately in the range of 29-32 inches includes approximately between 50,000 and 200,000 protrusions. In an embodiment, the height of each protrusion on a polishing pad is approximately in the range of 0.5-1 millimeter.

Within a same polishing surface of a polishing pad, in an embodiment, the above described protrusions need not all be same size. For example, in one embodiment, in a same polishing surface, a first of protrusions has a first maximum lateral dimension, while each protrusion of a second portion of protrusions has a second, different, maximum lateral dimension. In a specific and exemplary such embodiment, a pattern of a plurality of protrusions includes a protrusion having a maximum lateral dimension of approximately 10 millimeters surrounded by a plurality of protrusions each having a maximum lateral dimension of approximately 1 millimeter.

Additionally or alternatively, within a same polishing surface of a polishing pad, in an embodiment, the above described protrusions need not all have a same shape. For example, in one embodiment, each protrusion of a first portion of protrusions on the polishing surface has a first shape in a plane of the polishing surface, while each protrusion of a second portion of protrusions has a second, different, shape in the plane of the polishing surface. Furthermore or alternatively, within a same polishing surface of a polishing pad, in an embodiment, the above described protrusions need not all have a same height. However, the highest point of all protrusions may be co-planar (e.g., the portions of each of the protrusions that is in contact with a wafer or substrate during polishing forms a substantially planar surface). For example in one embodiment, each protrusion of a first portion of protrusions has a first height from the polishing body, while each protrusion of a second portion of protrusions has a second, different, height from the polishing body. Nonetheless, all of the protrusions from the first and second portions are substantially co-planar distal from the polishing body. Such an arrangement may enable formation of reservoirs or other slurry handling features within the polishing pad while maintaining a planar polishing surface.

In an embodiment, polishing pads described herein, such as polishing pad 200 or 800, or the above described variations thereof, the total surface area of the plurality of protrusions is a portion approximately in the range of 40-80% of the total surface area of the polishing side of the polishing body. In a first exemplary embodiment, protrusion that are hexagonal packed circular cylinders (e.g., as described in association with FIGS. 2B and 5A) having a diameter of approximately 80 mils and a spacing of approximately 20 mils provide a contact area of protrusion surface of approximately 58%. In a second exemplary embodiment, protrusion that are square packed circular cylinders (e.g., as described in association with FIG. 5B) having a diameter of approximately 80 mils and a spacing of approximately 16 mils provide a contact area of protrusion surface of approximately 54.5%. In a third exemplary embodiment, protrusion that are square packed circular cylinders and having XY channels between regions of protrusions (e.g., as described in association with FIG. 5C) having a diameter of approximately 80 mils and a spacing of approximately 16 mils, or approximately 35 mils between regions at the XY channels, provides contact area of protrusion surface of approximately 48%. In a fourth exemplary embodiment, protrusions that are molded squares with rounded corners packed in an XY grid (e.g., as described in association with FIG. 8A) having a maximum lateral dimension of approximately 120 mils and a spacing of approximately 40 mils provides a contact area of protrusion surface of approximately 54.3%.

In an embodiment, polishing pads described herein, such as polishing pad 200 or 800, or the above described variations thereof, are suitable for polishing substrates. The substrate may be one used in the semiconductor manufacturing industry, such as a silicon substrate having device or other layers disposed thereon. However, the substrate may be one such as, but not limited to, a substrates for MEMS devices, reticles, or solar modules. Thus, reference to "a polishing pad for polishing a substrate," as used herein, is intended to encompass these and related possibilities.

Polishing pads described herein, such as polishing pad 200 or 800, or the above described variations thereof, may be composed of a homogeneous polishing body of a thermoset polyurethane material. In an embodiment, the homogeneous polishing body is composed of a thermoset, closed cell polyurethane material. In an embodiment, the term "homogeneous" is used to indicate that the composition of a thermoset, closed cell polyurethane material is consistent throughout the entire composition of the polishing body. For example, in an embodiment, the term "homogeneous" excludes polishing pads composed of, e.g., impregnated felt or a composition (composite) of multiple layers of differing material. In an embodiment, the term "thermoset" is used to indicate a polymer material that irreversibly cures, e.g., the precursor to the material changes irreversibly into an infusible, insoluble polymer network by curing. For example, in an embodiment, the term "thermoset" excludes polishing pads composed of, e.g., "thermoplast" materials or "thermoplastics"—those materials composed of a polymer that turns to a liquid when heated and returns to a very glassy state when cooled sufficiently. It is noted that polishing pads made from thermoset materials are typically fabricated from lower molecular weight precursors reacting to form a polymer in a chemical reaction, while pads made from thermoplastic materials are typically fabricated by heating a pre-existing polymer to cause a phase change so that a polishing pad is formed in a physical process. Polyurethane thermoset polymers may be selected for fabricating polishing pads described herein based on their stable thermal and mechanical properties, resistance to the chemical environment, and tendency for wear resistance.

In an embodiment, the homogeneous polishing body, upon conditioning and/or polishing, has a polishing surface roughness approximately in the range of 1-5 microns root mean square. In one embodiment, the homogeneous polishing body, upon conditioning and/or polishing, has a polishing surface roughness of approximately 2.35 microns root mean square. In an embodiment, the homogeneous polishing body has a storage modulus at 25 degrees Celsius approximately in the range of 30-120 megaPascals (MPa). In another embodiment, the homogeneous polishing body has a storage modulus at 25 degrees Celsius approximately less than 30 megaPascals (MPa). In one embodiment, the homogeneous polishing body has a compressibility of approximately 2.5%. In one embodiment, the homogeneous polishing body has a density approximately in the range of 0.70-1.05 grams per cubic centimeter.

In an embodiment, polishing pads described herein, such as polishing pad 200 or 800, or the above described variations thereof, include a molded homogeneous polishing body. The term "molded" is used to indicate that a homogeneous polishing body is formed in a formation mold, as described in more detail below in association with FIGS. 11A-11F.

In an embodiment, polishing pads described herein, such as polishing pad 200 or 800, or the above described variations thereof, include a polishing body having a plurality of closed cell pores therein. In one embodiment, the plurality of closed cell pores is a plurality of porogens. For example, the term "porogen" may be used to indicate micro- or nano-scale spherical or somewhat spherical particles with "hollow" centers. The hollow centers are not filled with solid material, but may rather include a gaseous or liquid core. In one embodiment, the plurality of closed cell pores is composed of pre-expanded and gas-filled EXPANCEL™ distributed throughout (e.g., as an additional component in) a homogeneous polishing body of the polishing pad. In a specific embodiment, the EXPANCEL™ is filled with pentane. In an embodiment, each of the plurality of closed cell pores has a diameter approximately in the range of 10-100 microns. In an embodiment, the plurality of closed cell pores includes pores that are discrete from one another. This is in contrast to open cell pores which may be connected to one another through tunnels, such as the case for the pores in a common sponge. In one embodiment, each of the closed cell pores includes a physical shell, such as a shell of a porogen, as described above. In another embodiment, however, each of the closed cell pores does not include a physical shell. In an embodiment, the plurality of closed cell pores is distributed essentially evenly throughout a thermoset polyurethane material of a homogeneous polishing body. In one embodiment, the homogeneous polishing body has a pore density approximately in the range of 6%-50% total void volume, and possibly approximately in the range of 15%-35% total void volume. In one embodiment, the homogeneous polishing has a porosity of the closed cell type, as described above, due to inclusion of a plurality of porogens.

In an embodiment, the homogeneous polishing body is opaque. In one embodiment, the term "opaque" is used to indicate a material that allows approximately 10% or less visible light to pass. In one embodiment, the homogeneous polishing body is opaque in most part, or due entirely to, the inclusion of an opacifying lubricant throughout (e.g., as an additional component in) the homogeneous thermoset, closed cell polyurethane material of the homogeneous polishing body. In a specific embodiment, the opacifying lubricant is a material such as, but not limited to: boron nitride, cerium fluoride, graphite, graphite fluoride, molybdenum sulfide, niobium sulfide, talc, tantalum sulfide, tungsten disulfide, or Teflon.

The sizing of the homogeneous polishing body may be varied according to application. Nonetheless, certain parameters may be used to make polishing pads including such a homogeneous polishing body compatible with conventional processing equipment or even with conventional chemical mechanical processing operations. For example, in accordance with an embodiment of the present invention, the homogeneous polishing body has a thickness approximately in the range of 0.075 inches to 0.130 inches, e.g., approximately in the range of 1.9-3.3 millimeters. In one embodiment, the homogeneous polishing body has a diameter approximately in the range of 20 inches to 30.3 inches, e.g., approximately in the range of 50-77 centimeters, and possibly approximately in the range of 10 inches to 42 inches, e.g., approximately in the range of 25-107 centimeters.

Figure 10:
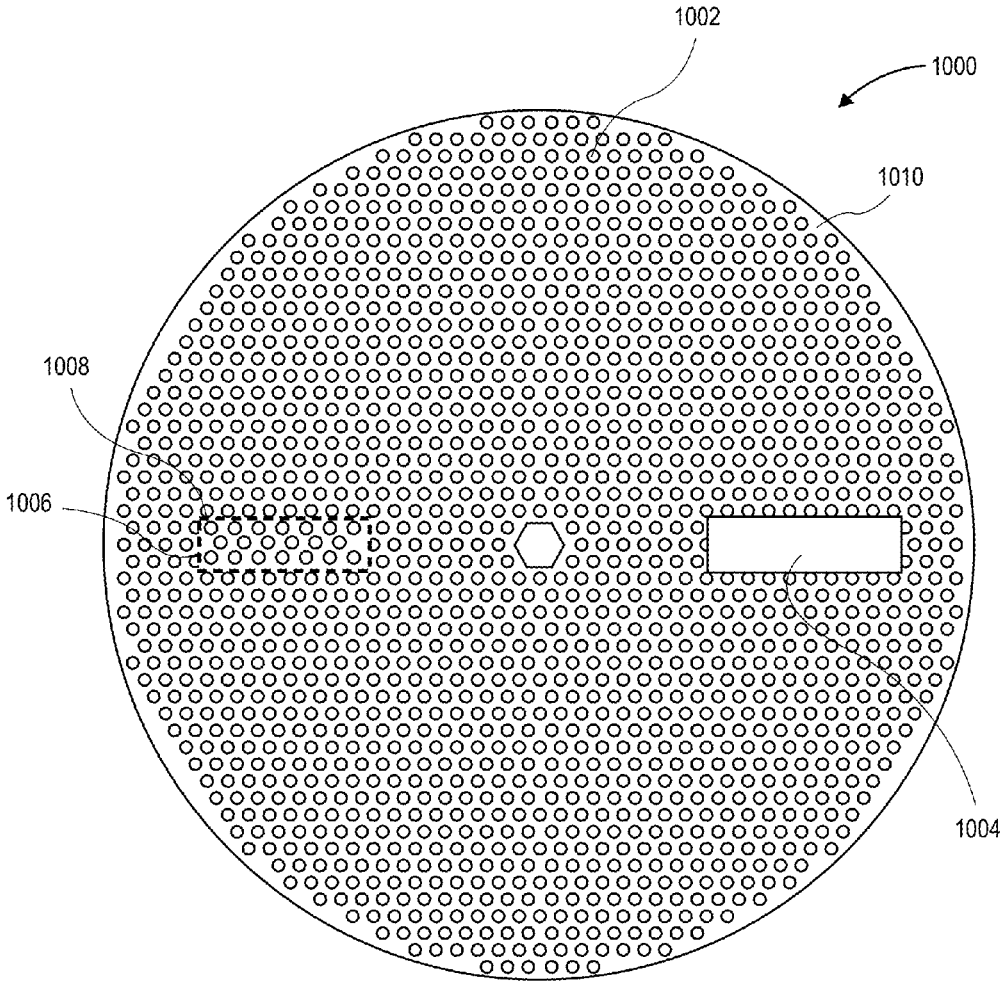
FIG. 10 illustrates a top-down plan view of a protrusion pattern, the pattern interrupted by a local area transparency (LAT) region and/or an indication region, disposed in the polishing surface of a polishing pad, in accordance with an embodiment of the present invention.

In another embodiment of the present invention, a polishing pad with a polishing surface having a plurality of continuous protrusions thereon further includes a local area transparency (LAT) region disposed in the polishing pad. For example, FIG. 10 illustrates a top-down plan view of a protrusions pattern, the pattern interrupted by a local area transparency (LAT) region and/or an indication region, disposed in the polishing surface 1002 of a polishing pad 1000, in accordance with an embodiment of the present invention. Specifically, a LAT region 1004 is disposed in the polishing body of polishing pad 1000. As depicted in FIG. 10, the LAT region 1004 interrupts a pattern of protrusions 1010. In an embodiment, the LAT region 1004 is disposed in, and covalently bonded with, a homogeneous polishing body of the polishing pad 1000. Examples of suitable LAT regions are described in U.S. patent application Ser. No. 12/657,135 filed on Jan. 13, 2010, assigned to NexPlanar Corporation, and U.S. patent application Ser. No. 12/895,465 filed on Sep. 30, 2010, assigned to NexPlanar Corporation.

In an alternative embodiment, a polishing pad described herein further includes an aperture disposed in the polishing surface and polishing body. An adhesive sheet is disposed on the back surface of the polishing body. The adhesive sheet provides an impermeable seal for the aperture at the back surface of the polishing body. Examples of suitable apertures are described in U.S. patent application Ser. No. 13/184,395 filed on Jul. 15, 2011, assigned to NexPlanar Corporation.

In another embodiment, a polishing pad with a polishing surface having a pattern of continuous protrusions thereon further includes a detection region for use with, e.g., an eddy current detection system. For example, referring again to FIG. 10, the polishing surface 1002 of polishing pad 1000 includes an indication region 1006 indicating the location of a detection region disposed in the back surface of the polishing pad 1000. In one embodiment, the indication region 1006 interrupts pattern of protrusions 1010 with a second pattern of protrusions 1008, as depicted in FIG. 10. Examples of suitable eddy current detection regions are described in U.S. patent application Ser. No. 12/895,465 filed on Sep. 30, 2010, assigned to NexPlanar Corporation.

Polishing pads described herein, such as polishing pad 200 or 800, or the above described variations thereof, may further include a foundation layer disposed on the back surface of the polishing body. In one such embodiment, the result is a polishing pad with bulk or foundation material different from the material of the polishing surface. In one embodiment, a composite polishing pad includes a foundation or bulk layer fabricated from a stable, essentially non-compressible, inert material onto which a polishing surface layer is disposed. A harder foundation layer may provide support and strength for pad integrity while a softer polishing surface layer may reduce scratching, enabling decoupling of the material properties of the polishing layer and the remainder of the polishing pad. Examples of suitable foundation layers are described in U.S. patent application Ser. No. 13/306,845 filed on Nov. 29, 2011, assigned to NexPlanar Corporation.

Polishing pads described herein, such as polishing pad 200 or 800, or the above described variations thereof, may further include a sub pad disposed on the back surface of the polishing body, e.g., a conventional sub pad as known in the CMP art. In one such embodiment, the sub pad is composed of a material such as, but not limited to, foam, rubber, fiber, felt or a highly porous material.

In another aspect of the present invention, polishing a polishing surface with continuous protrusions may be fabricated in a molding process. For example, FIGS. 11A-11F illustrate cross-sectional views of operations used in the fabrication of a polishing pad, in accordance with an embodiment of the present invention.

Figure 11A:
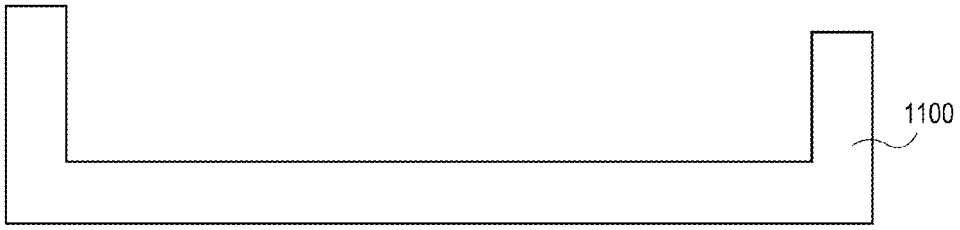
FIGS. 11A-11F illustrate cross-sectional views of operations used in the fabrication of a polishing pad, in accordance with an embodiment of the present invention.
Figure 11B:
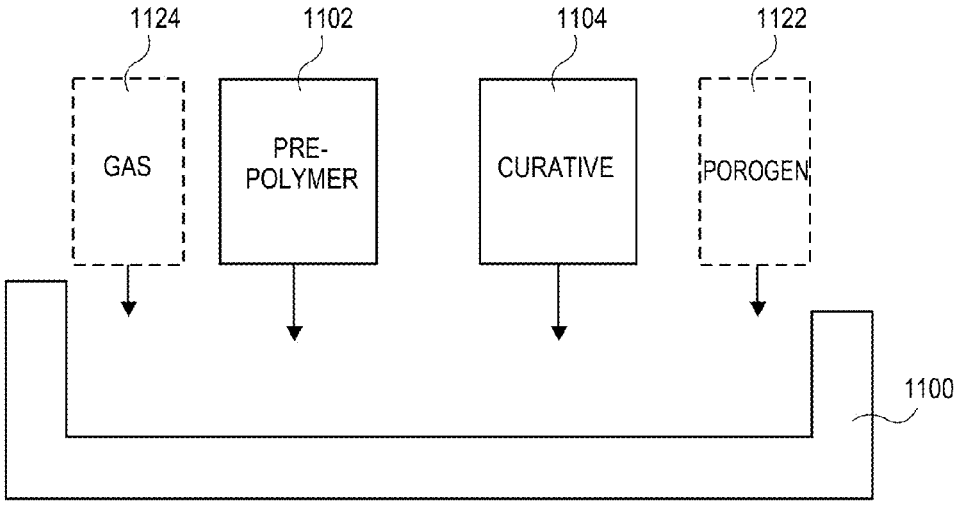
Figure 11C:
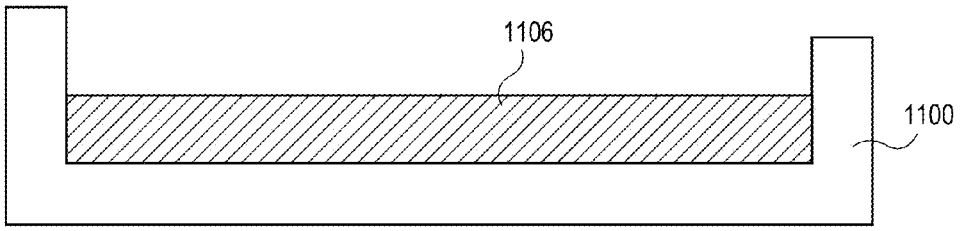

Referring to FIG. 11A, a formation mold 1100 is provided. Referring to FIG. 11B, a pre-polymer 1102 and a curative 1104 are mixed to form a mixture 1106 in the formation mold 1100, as depicted in FIG. 11C. In an embodiment, mixing the pre-polymer 1102 and the curative 1104 includes mixing an isocyanate and an aromatic diamine compound, respectively. In one embodiment, the mixing further includes adding an opacifying lubricant to the pre-polymer 1102 and the curative 1104 to ultimately provide an opaque molded homogeneous polishing body. In a specific embodiment, the opacifying lubricant is a material such as, but not limited to: boron nitride, cerium fluoride, graphite, graphite fluoride, molybdenum sulfide, niobium sulfide, talc, tantalum sulfide, tungsten disulfide, or Teflon.

In an embodiment, the polishing pad precursor mixture 1106 is used to ultimately form a molded homogeneous polishing body composed of a thermoset, closed cell polyurethane material. In one embodiment, the polishing pad precursor mixture 1106 is used to ultimately form a hard pad and only a single type of curative is used. In another embodiment, the polishing pad precursor mixture 1106 is used to ultimately form a soft pad and a combination of a primary and a secondary curative is used. For example, in a specific embodiment, the pre-polymer includes a polyurethane precursor, the primary curative includes an aromatic diamine compound, and the secondary curative includes a compound having an ether linkage. In a particular embodiment, the polyurethane precursor is an isocyanate, the primary curative is an aromatic diamine, and the secondary curative is a curative such as, but not limited to, polytetramethylene glycol, amino-functionalized glycol, or amino-functionalized polyoxypropylene. In an embodiment, the pre-polymer, a primary curative, and a secondary curative have an approximate molar ratio of 100 parts pre-polymer, 85 parts primary curative, and 15 parts secondary curative. It is to be understood that variations of the ratio may be used to provide polishing pads with varying hardness values, or based on the specific nature of the pre-polymer and the first and second curatives.

Figure 11D:
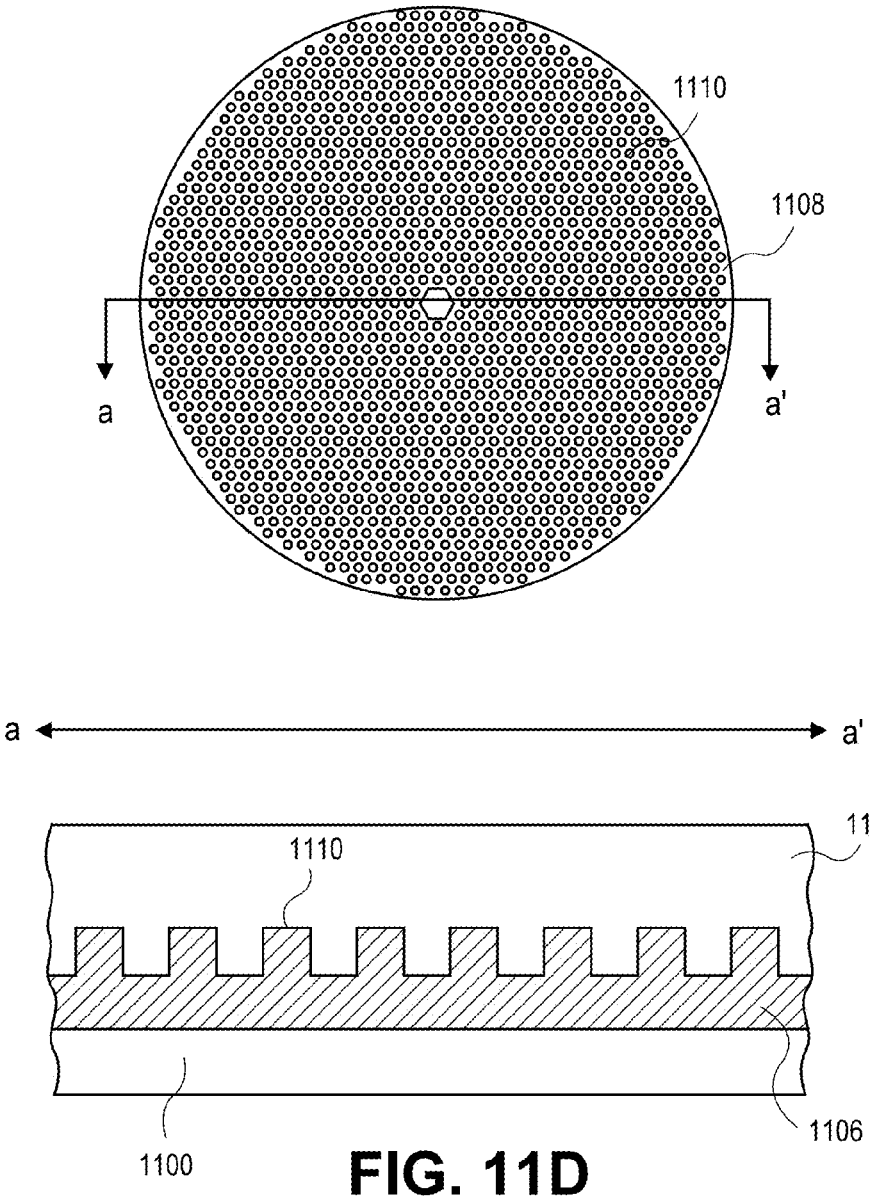

Referring to FIG. 11D, a lid 1108 of the formation mold 1100 is lowered into the mixture 1106. A top-down plan view of lid 1108 is shown on top, while a cross-section along the a-a' axis is shown below in FIG. 11D. In an embodiment, the lid 1108 has disposed thereon a pattern of grooves 1110, e.g., cylindrical grooves. The pattern of grooves 1110 is used to stamp a pattern of protrusions into a polishing surface of a polishing pad formed in formation mold 1100.

It is to be understood that embodiments described herein that describe lowering the lid 1108 of a formation mold 1100 need only achieve a bringing together of the lid 1108 and a base of the formation mold 1100. That is, in some embodiments, a base of a formation mold 1100 is raised toward a lid 1108 of a formation mold, while in other embodiments a lid 1108 of a formation mold 1100 is lowered toward a base of the formation mold 1100 at the same time as the base is raised toward the lid 1108.

Figure 11E:
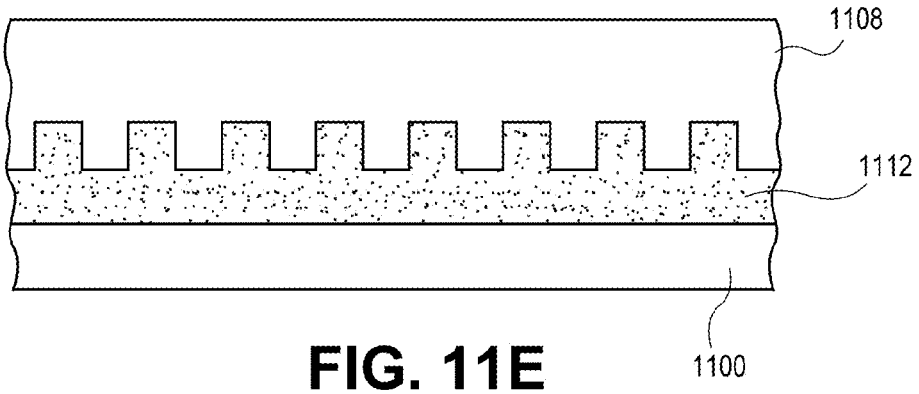

Referring to FIG. 11E, the mixture 1106 is cured to provide a molded homogeneous polishing body 1112 in the formation mold 1100. The mixture 1106 is heated under pressure (e.g., with the lid 1108 in place) to provide the molded homogeneous polishing body 1112. In an embodiment, heating in the formation mold 1100 includes at least partially curing in the presence of lid 1108, which encloses mixture 1106 in formation mold 1100, at a temperature approximately in the range of 200-260 degrees Fahrenheit and a pressure approximately in the range of 2-12 pounds per square inch.

Figure 11F:
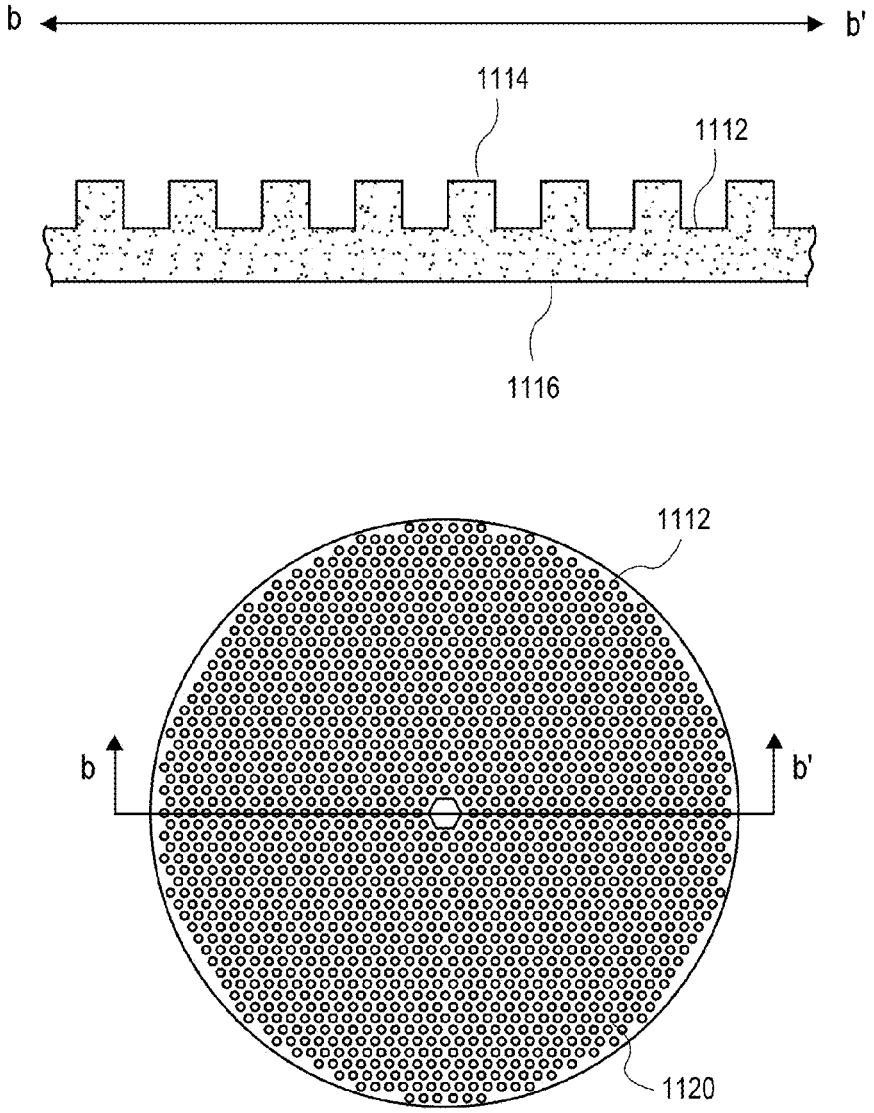

Referring to FIG. 11F, a polishing pad (or polishing pad precursor, if further curing is required) is separated from lid 1108 and removed from formation mold 1100 to provide the discrete molded homogeneous polishing body 1112. A top-down plan view of molded homogeneous polishing body 1112 is shown below, while a cross-section along the b-b' axis is shown above in FIG. 11F. It is noted that further curing through heating may be desirable and may be performed by placing the polishing pad in an oven and heating. Thus, in one embodiment, curing the mixture 1106 includes first partially curing in the formation mold 1100 and then further curing in an oven. Either way, a polishing pad is ultimately provided, wherein a molded homogeneous polishing body 1112 of the polishing pad has a polishing surface 1114 and a back surface 1116. In an embodiment, the molded homogeneous polishing body 1112 is composed of a thermoset polyurethane material and a plurality of closed cell pores disposed in the thermoset polyurethane material. The molded homogeneous polishing body 1112 includes a polishing surface 1114 having disposed therein a pattern of protrusions 1120 corresponding to the pattern of grooves 1110 of the lid 1108. The pattern of protrusions 1120 may be a pattern of protrusions as described above, e.g., with respect to FIGS. 2A-2C, 3A, 3B, 4, 5A-5C, 6A-6D, 7, 8A-8C, 9A and 9B.

In an embodiment, referring again to FIG. 11B, the mixing further includes adding a plurality of porogens 1122 to the pre-polymer 1102 and the curative 1104 to provide closed cell pores in the ultimately formed polishing pad. Thus, in one embodiment, each closed cell pore has a physical shell. In another embodiment, referring again to FIG. 11B, the mixing further includes injecting a gas 1124 into to the pre-polymer 1102 and the curative 1104, or into a product formed there from, to provide closed cell pores in the ultimately formed polishing pad. Thus, in one embodiment, each closed cell pore has no physical shell. In a combination embodiment, the mixing further includes adding a plurality of porogens 1122 to the pre-polymer 1102 and the curative 1104 to provide a first portion of closed cell pores each having a physical shell, and further injecting a gas 1124 into the pre-polymer 1102 and the curative 1104, or into a product formed there from, to provide a second portion of closed cell pores each having no physical shell. In yet another embodiment, the pre-polymer 1102 is an isocyanate and the mixing further includes adding water ($H_2O$) to the pre-polymer 1102 and the curative 1104 to provide closed cell pores each having no physical shell.

Thus, protrusion patterns contemplated in embodiment of the present invention may be formed in-situ. For example, as described above, a compression-molding process may be used to form polishing pads with a polishing surface having a pattern of continuous protrusions. By using a molding process, highly uniform protrusion dimensions within-pad may be achieved. Furthermore, extremely reproducible protrusion dimensions along with very smooth, clean protrusion surfaces may be produced. Other advantages may include reduced defects and micro-scratches and a greater usable protrusion depth.

Polishing pads described herein may be suitable for use with a variety of chemical mechanical polishing apparatuses. As an example, FIG. 12 illustrates an isometric side-on view of a polishing apparatus compatible with a polishing pad having a polishing surface with continuous protrusions, in accordance with an embodiment of the present invention.

Figure 12:
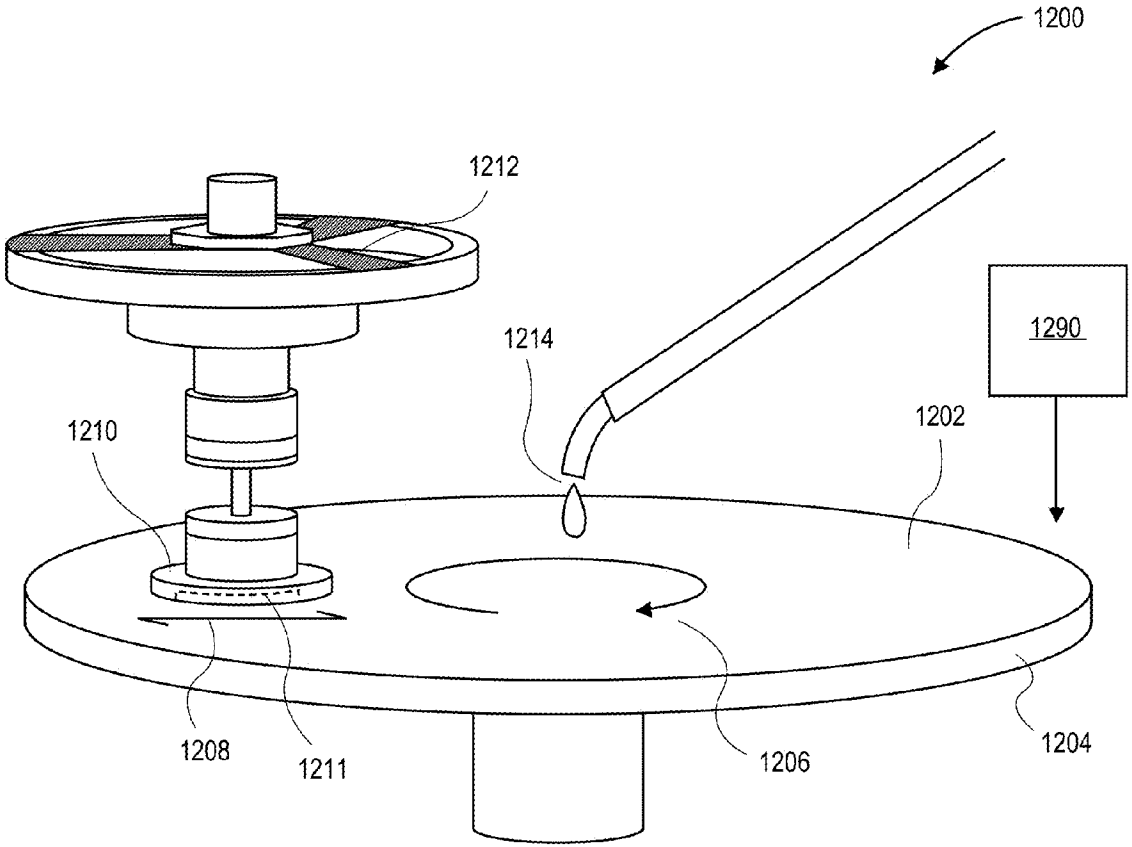
FIG. 12 illustrates an isometric side-on view of a polishing apparatus compatible with a polishing pad having a polishing surface with continuous protrusions, in accordance with an embodiment of the present invention.

Referring to FIG. 12, a polishing apparatus 1200 includes a platen 1204. The top surface 1202 of platen 1204 may be used to support a polishing pad with a pattern of polishing protrusions thereon. Platen 1204 may be configured to provide spindle rotation 1206 and slider oscillation 1208. A sample carrier 1210 is used to hold, e.g., a semiconductor wafer 1211 in place during polishing of the semiconductor wafer with a polishing pad. Sample carrier 1210 is further supported by a suspension mechanism 1212. A slurry feed 1214 is included for providing slurry to a surface of a polishing pad prior to and during polishing of the semiconductor wafer. A conditioning unit 1290 may also be included and, in one embodiment, includes a diamond tip for conditioning a polishing pad.

Thus, polishing pads having a polishing surface with continuous protrusions have been disclosed. In accordance with an embodiment of the present invention, a polishing pad for polishing a substrate includes a polishing body having a polishing side opposite a back surface. The polishing pad also includes a polishing surface having a plurality of cylindrical protrusions continuous with the polishing side of the polishing body. In one embodiment, each of the plurality of cylindrical protrusions has a shape in a plane of the polishing surface such as, but not limited to, a circle, an oval, a triangle, or a polygon having five or more sides. In accordance with an embodiment of the present invention, a polishing pad for polishing a substrate includes a polishing body having a polishing side opposite a back surface. The polishing pad also includes a polishing surface having a plurality of protrusions continuous with the polishing side of the polishing body. Each protrusion has a modified-quadrilateral polygon shape in a plane of the polishing surface. In one embodiment, the modified-quadrilateral polygon shape is such as, but not limited to, a quadrilateral polygon with one or more rounded corners, a quadrilateral polygon with one or more notched corners or a quadrilateral polygon with one or more arced sides.

What is claimed is:

1. A polishing pad for polishing a substrate, the polishing pad comprising:

a polishing body having a polishing side opposite a back surface;

a polishing surface comprising a plurality of cylindrical protrusions continuous with the polishing side of the polishing body, wherein the plurality of cylindrical protrusions is arranged in a hexagonal-packed pattern; and a solid ring encompassing the plurality of cylindrical protrusions at an outer most edge of the polishing side of the polishing body, the solid ring continuous with the polishing side of the polishing body and having an inner shape that follows a contour of the hexagonal-packed pattern of the plurality of cylindrical protrusions, wherein the hexagonal-packed pattern of the plurality of cylindrical protrusions is interrupted by a plurality of grooves within the solid ring.

2. The polishing pad of claim 1, wherein the each of the plurality of cylindrical protrusions has a shape in a plane of the polishing surface that is selected from the group consisting of a circle, an oval, a triangle, and a polygon having five or more sides.

3. The polishing pad of claim 1, wherein the hexagonal-packed pattern of the plurality of cylindrical protrusions terminates proximate to the ring in a staggered arrangement.

4. The polishing pad of claim 1, further comprising:

a button region disposed centrally within the hexagonal-packed pattern of the plurality of cylindrical protrusions, the button region having a hexagonal shape.

5. The polishing pad of claim 4, wherein the button region further comprises a triangular clocking mark on one side of the hexagonal shape.

6. The polishing pad of claim 1, wherein the plurality of cylindrical protrusions is arranged in a plurality of high density regions having less spacing between adjacent protrusions within a high density region than between adjacent protrusions of adjacent high density regions.

7. The polishing pad of claim 1, wherein each of the plurality of cylindrical protrusions has a maximum lateral dimension approximately in the range of 1-30 millimeters, with a spacing between one another approximately in the range of 0.1-3 millimeters.

8. The polishing pad of claim 1, wherein each cylindrical protrusion of a first portion of the plurality of cylindrical protrusions has a first maximum lateral dimension, and each cylindrical protrusion of a second portion of the plurality of cylindrical protrusions has a second, different, maximum lateral dimension.

9. The polishing pad of claim 8, wherein a pattern of the plurality of cylindrical protrusions comprises a cylindrical protrusion having a maximum lateral dimension of approximately 10 millimeters surrounded by a plurality of cylindrical protrusions each having a maximum lateral dimension of approximately 1 millimeter.

10. The polishing pad of claim 1, wherein each cylindrical protrusion of a first portion of the plurality of cylindrical protrusions has a first shape in a plane of the polishing surface, and each cylindrical protrusion of a second portion of the plurality of cylindrical protrusions has a second, different, shape in the plane of the polishing surface.

11. The polishing pad of claim 1, wherein the total surface area of the plurality of cylindrical protrusions is a portion approximately in the range of 40-80% of the total surface area of the polishing side of the polishing body.

12. The polishing pad of claim 1, wherein the height of each of the plurality of cylindrical protrusions is approximately in the range of 0.5-1 millimeter.

13. The polishing pad of claim 1, wherein the plurality of cylindrical protrusions comprises approximately between 50,000-200,000 protrusions for a polishing pad having a diameter approximately in the range of 29-32 inches.

14. The polishing pad of claim 1, wherein each cylindrical protrusion of a first portion of the plurality of cylindrical protrusions has a first height from the polishing body, and each cylindrical protrusion of a second portion of the plurality of cylindrical protrusions has a second, different, height from the polishing body, but all of the plurality of cylindrical protrusions are substantially co-planar distal from the polishing body.

15. The polishing pad of claim 1, wherein the polishing body and polishing surface are together homogeneous and unitary.

16. The polishing pad of claim 15, wherein the polishing body and polishing surface comprise a molded polyurethane material.

17. The polishing pad of claim 16, wherein the molded polyurethane material has a pore density of closed cell pores approximately in the range of 6%-50% total void volume.

18. The polishing pad of claim 1, further comprising:

a foundation layer disposed on the back surface of the polishing body.

19. The polishing pad of claim 1, further comprising:

a detection region disposed in the back surface of the polishing body.

20. The polishing pad of claim 1, further comprising:

an aperture disposed in the polishing surface and polishing body; and an adhesive sheet disposed on the back surface of the polishing body, the adhesive sheet providing an impermeable seal for the aperture at the back surface of the polishing body.

21. The polishing pad of claim 1, further comprising:

a sub pad disposed on the back surface of the polishing body.

22. The polishing pad of claim 1, further comprising:

a local area transparency (LAT) region disposed in the polishing body, the LAT region interrupting a pattern of the plurality of cylindrical protrusions.

* * * * *